US009470235B2

(12) United States Patent
Sumimoto

(10) Patent No.: US 9,470,235 B2
(45) Date of Patent: Oct. 18, 2016

(54) VACUUM PUMP

(71) Applicant: SHIMADZU CORPORATION, Kyoto (JP)

(72) Inventor: Shin Sumimoto, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 399 days.

(21) Appl. No.: 14/197,523

(22) Filed: Mar. 5, 2014

(65) Prior Publication Data

US 2014/0271160 A1 Sep. 18, 2014

(30) Foreign Application Priority Data

Mar. 13, 2013 (JP) ..... 2013-050832
Nov. 20, 2013 (JP) ..... 2013-239907

(51) Int. Cl.
*F04D 19/04* (2006.01)
*F04D 29/54* (2006.01)

(52) U.S. Cl.
CPC ..... *F04D 19/042* (2013.01); *F04D 29/544* (2013.01)

(58) Field of Classification Search
CPC .... F04D 19/04; F04D 19/042; F04D 19/044; F04D 29/542
USPC ..... 415/90, 143, 209.1–209.4, 210.1; 417/423.4
See application file for complete search history.

(56) References Cited

U.S. PATENT DOCUMENTS 5,158,426 A * 10/1992 Casaro ..... F04D 19/042 403/340
7,824,153 B2 11/2010 Akimoto et al.

FOREIGN PATENT DOCUMENTS

DE 297 15 035 U1 * 12/1997 ..... F04D 19/04
EP 2 458 222 A2 * 5/2012 ..... F04D 19/04
JP 2008-144694 6/2008
JP 4676731 2/2011

OTHER PUBLICATIONS

Machine translation of JP 2008-144,694, Jun. 2008.*
Machine translation of DE 297 15 035 U1, Dec. 1997.*
Machine translation of EP 2 458 222 A2, May 2012.*
English translation of Chinese Office Action dated Dec. 16, 2015 for corresponding Chinese Application No. 201410079364.3.
English translation of Chinese Office Action dated Jun. 14, 2016 for corresponding Chinese Application No. 201410079364.3.

* cited by examiner

*Primary Examiner* — Christopher Verdier
(74) *Attorney, Agent, or Firm* — Renner, Otto, Boisselle & Sklar, LLP

(57) ABSTRACT

A vacuum pump comprises an exhaust portion having a plurality of rotating blade portions arranged in multiple stages, each of the rotating blade portions having a plurality of rotor blades, and a plurality of stationary blade portions arranged between the rotating blade portions, in which outer circumferential rims are supported via spacers, each of the stationary blade portions having a plurality of stator blades. In at least one stationary blade portion among the plurality of stationary blade portions, a blade height on the inner circumferential side of the plurality of stator blades provided in the stationary blade portion is set to be smaller than a blade height on the outer circumferential side, and the stationary blade portion is supported by the spacers in such a manner that the inner circumferential side of the stationary blade portion is floated up toward an intake port side.

4 Claims, 13 Drawing Sheets

Embodiment 2

Embodiment 3

VACUUM PUMP

BACKGROUND OF THE INVENTION

1. Field of the Invention

This invention relates to a vacuum pump having an exhaust portion formed by rotating blade portions and stationary blade portions.

2. Description of the Related Art

In a vacuum pump such as a turbo-molecular pump, a rotor having rotating blade portions arranged in multiple stages is rotated at high speed in a pump container formed by a casing member and a base member, and a gas molecule is moved from the intake port side to the exhaust port side by the rotating blade portions and stationary blade portions arranged between the stages of the rotating blade portions.

Each stage of the rotating blade portions has rotor blades, and each stage of the stationary blade portions has stator blades. The stationary blade portions are supported at predetermined intervals by spacers arranged on the outer circumferential side of the stationary blade portions. The stationary blade portions are formed into one ring shape by combining a pair of halved ring shape members. That is, one ring is formed by abutting two side end surfaces each other in the radial direction of the halved ring shape members. The rotor blades and the stator blades are formed so as to be inclined with respect to a rotation surface of the rotor. Gaps of predetermined dimension are provided between the rotor blades and the stator blades.

As a method of manufacturing the stationary blade portions, there are a method of forming by mechanical working and a method of forming by plastic working. The method of manufacturing by the plastic working is advantageous in terms of cost.

In the method of forming by the plastic working, a plurality of stator blades formed by pressing a plate and arranged at a predetermined inclination angle along the circumferential direction is coupled by an inner circumferential rim serving as an inner circumferential edge and an outer circumferential rim serving as an outer circumferential edge, so that a stationary blade portion is manufactured (for example, refer to JP 2008-144694 A).

Due to variation at the time of the working, in the stationary blade portion supported by spacers, the side of the inner circumferential rim is displaced in the axial direction of a rotor with respect to the side of the outer circumferential rim. By this displacement, a risk that the stationary blade portions are brought into contact into the rotating blade portions is generated.

SUMMARY OF THE INVENTION

A vacuum pump comprises: an exhaust portion having a plurality of rotating blade portions arranged in multiple stages, each of the rotating blade portions having a plurality of rotor blades, and a plurality of stationary blade portions arranged between the rotating blade portions, in which outer circumferential rims are supported via spacers, each of the stationary blade portions having a plurality of stator blades. In at least one stationary blade portion among the plurality of stationary blade portions, a blade height on the inner circumferential side of the plurality of stator blades provided in the stationary blade portion is set to be smaller than a blade height on the outer circumferential side, and the stationary blade portion is supported by the spacers in such a manner that the inner circumferential side of the stationary blade portion is floated up toward an intake port side.

The stationary blade portion includes an inner circumferential rim and the outer circumferential rim, the stator blades are provided between the inner circumferential rim and the outer circumferential rim, and by bending an outer circumferential edge of the outer circumferential rim, by a predetermined inclination angle, in the direction of upper surfaces of the stator blades from the outer circumferential rim, the inner circumferential rim is floated up to the intake port side.

A floating height s of a front end of the inner circumferential rim from the outer circumferential edge satisfies a relationship of:

$$(ho-hi)>s$$

in a case where the blade height on the outer circumferential side of the stator blades is ho and the blade height on the inner circumferential side of the stator blades is hi.

BRIEF DESCRIPTION OF THE DRAWINGS

FIG. 11 is views for illustrating a method of manufacturing a stator blade by drawing with using a punch PU and a die DI.

DETAILED DESCRIPTION OF PREFERRED EMBODIMENTS

Embodiment 1

Figure 1:
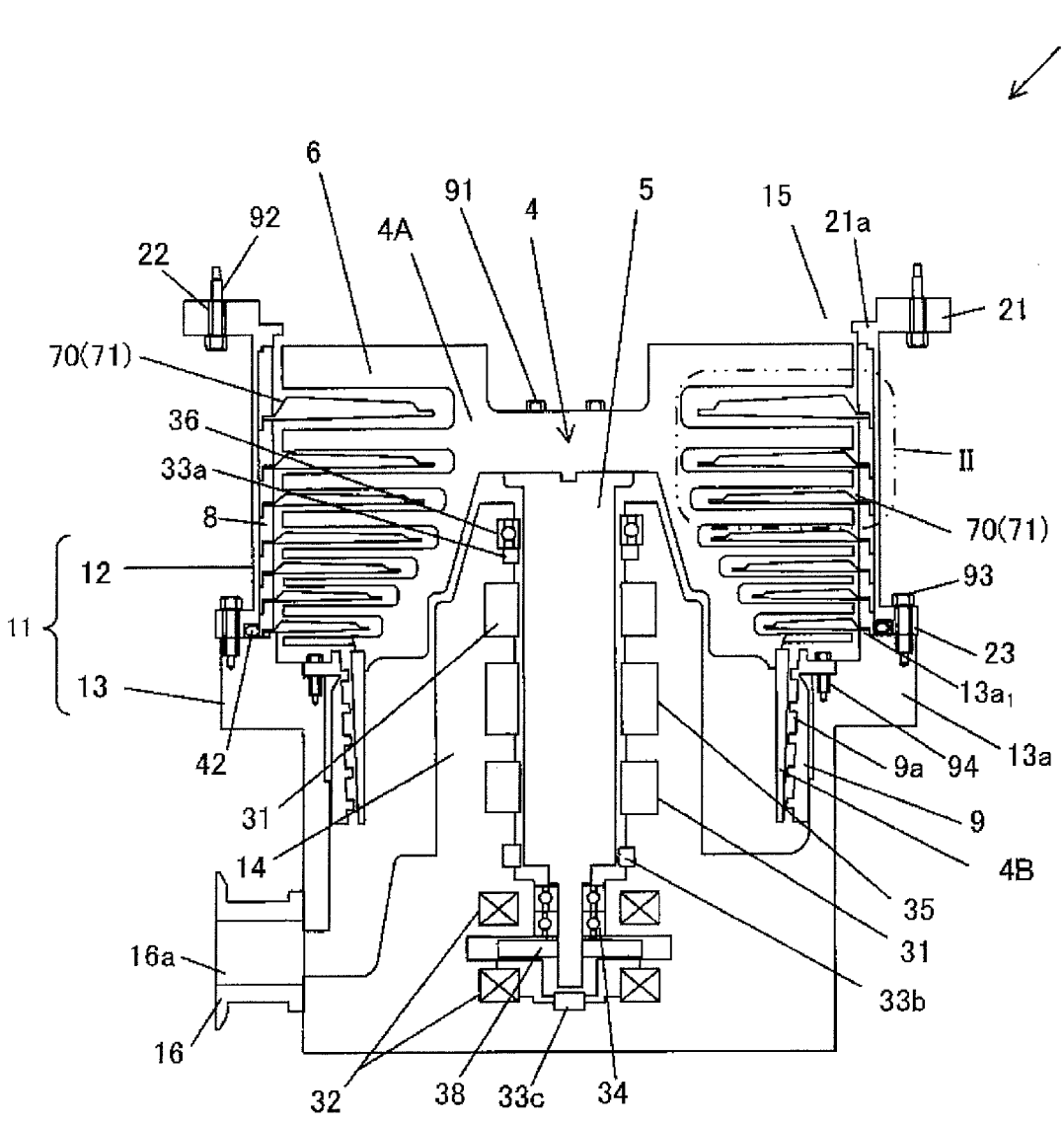
FIG. 1 is a sectional view of a turbo-molecular pump serving as one embodiment of a vacuum pump according to this invention.

Hereinafter, referring to the drawings, a vacuum pump according to the present invention will be described with a turbo-molecular pump as one embodiment.

(Entire Configuration of Vacuum Pump)

Figure 2:
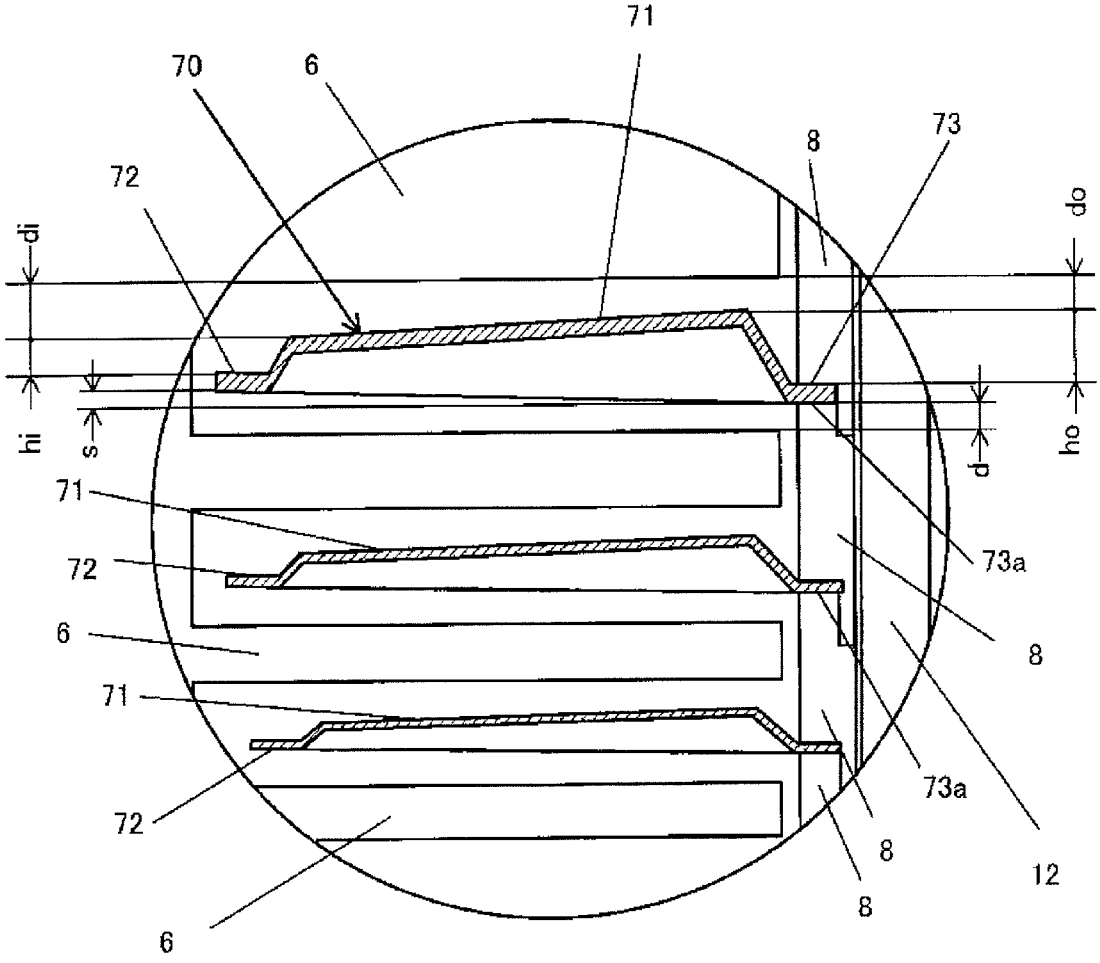
FIG. 2 is an enlarged view of a region II in FIG. 1.

FIG. 1 is a sectional view of a turbo-molecular pump 1, and FIG. 2 is an enlarged view of a region II in FIG. 1.

The turbo-molecular pump 1 includes a pump container 11 formed by a casing member 12 and a base 13 fixed to the casing member 12.

The casing member 12 has a substantially cylindrical shape, and formed by for example SUS, and an upper flange 21 is formed in an upper end. A disc shape intake port 15 is formed on the inner side of the upper flange 21 of the casing member 12. Through holes 22 for bolt insertion are formed in the upper flange 21 at substantially equal intervals along the circumferential direction. The turbo-molecular pump 1 is attached to an external device such as semiconductor manufacturing device by inserting bolts 92 into the through holes 22 of the upper flange 21.

A rotor 4 and a rotor shaft 5 attached coaxially with an axis of the rotor 4 are accommodated in the pump container 11. The rotor 4 and the rotor shaft 5 are fixed by bolts 91.

The rotor 4 includes a rotor upper portion 4A, and a rotor lower portion cylindrical portion 4B jointed to a lower surface of the rotor upper portion 4A. The rotor upper portion 4A is made of for example an aluminum alloy. In the rotor upper portion 4A, a plurality of rotating blade portions 6 formed in a radial manner and arranged in the circumferential direction is arranged in multiple stages at intervals in the axial direction of the rotor 4. The rotating blade portions 6 are formed at a predetermined inclination angle with respect to a rotation surface of the rotating blade portions 6. Stationary blade portions 70 are arranged between the stages of the plurality of rotating blade portions 6.

Although details will be described later, the stationary blade portions 70 are formed into one ring shape by combining a pair of halved ring shape members having a plurality of stator blades 71 arranged along the circumferential direction (refer to FIG. 5A, FIG. 5B and FIG. 5C). Each of the stationary blade portions 70 is nipped by ring-shaped spacers 8 arranged along an inner circumferential surface of the casing member 12, and the stationary blade portions are laminated in multiple stages (seven stages in the example shown in the figure). An upper surface of the uppermost spacer 8 is abutted with an inner part upper wall portion 21*a* on the inner surface side of the upper flange 21 of the casing member 12, and a lower surface of the lowermost spacer 8 is abutted with an abutting portion 13*a*1 provided on an upper surface of an upper flange 13*a* of the base 13. Therefore, the stationary blade portions 70 are given force in the rotation shaft direction and supported via the spacers 8 between the inner part upper wall portion 21*a* of the casing member 12 and the upper surface of the upper flange 13*a* of the base 13. In such a way, the rotating blade portions 6 and the stationary blade portions 70 are alternately laminated in multiple stages, so as to form a high-vacuum blade exhaust portion.

A ring shape threaded stator 9 is fixed to the base 13 by bolts 94 on the outer circumferential side of the rotor lower portion cylindrical portion 4B. A threaded groove portion 9*a* is formed in the threaded stator 9. A low-vacuum threaded groove exhaust portion is formed by the rotor lower portion cylindrical portion 4B of the rotor 4 and the threaded stator 9.

It should be noted that although the structure of forming the threaded groove portion 9*a* in the threaded stator 9 is shown as an example in FIG. 1, the threaded groove portion 9*a* may be formed on an outer circumferential surface of the rotor lower portion cylindrical portion 4B.

The base 13 is made of for example an aluminum alloy, and a center tube portion 14 in which a disc shape hollow part is formed for inserting the rotor shaft 5 is formed in a center part of the base 13. On the inner side of the center tube portion 14, a motor 35, (two) radial magnetic bearings 31, (a pair of upper and lower) thrust magnetic bearings 32, radial displacement sensors 33*a*, 33*b*, an axial displacement sensor 33*c*, mechanical bearings 34, 36, and a rotor disc 38 are attached.

The rotor shaft 5 is supported by the (two) radial magnetic bearings 31 and the (pair of upper and lower) thrust magnetic bearings 32 in non-contact manner. A position of the rotor shaft 5 at the time of rotation is controlled based on a radial position and an axial position detected by the radial displacement sensors 33*a*, 33*b* and the axial displacement sensor 33*c*. The rotor shaft 5 rotatably and magnetically floated up by the magnetic bearings 31, 32 is driven and rotated at high speed by the motor 35. By driving and rotating the rotor shaft 5, the rotor upper portion 4A coupled to the rotor shaft 5 is rotated and all the rotating blade portions 6 are integrally rotated.

The mechanical bearings 34, 36 are mechanical bearings for emergency, and when the magnetic bearings 31, 32 are not operated, the rotor shaft 5 is supported by the mechanical bearings 34, 36.

An exhaust port 16 is provided in the base 13, and an exhaust opening 16*a* is provided in the exhaust port 16.

A lower flange 23 of the casing member 12 and an upper flange 13*a* of the base 13 are fixed by bolts 93 through a seal member 42, so that the pump container 11 is formed.

As described above, the vacuum pump of the embodiment is a vacuum pump having an exhaust function portion in which the stationary blade portions 70 supported by the spacers 8 are respectively arranged between the rotating blade portions 6 arranged in multiple stages.

Hereinafter, the stationary blade portions 70 will be described in detail.

(Description of Stationary Blade Portion 70)

Figure 3:
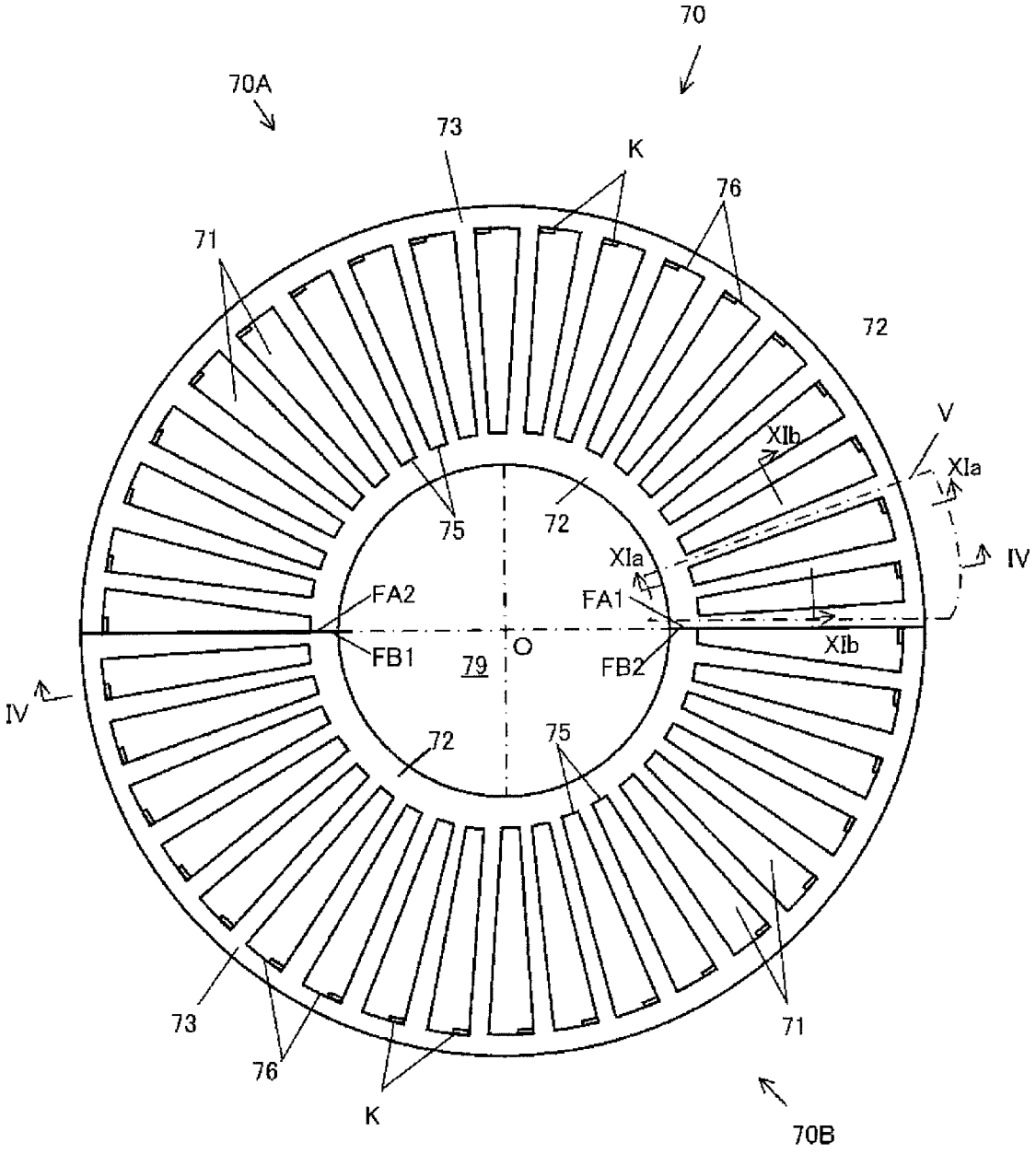
FIG. 3 is a plan view of a stationary blade portion.
Figure 4:
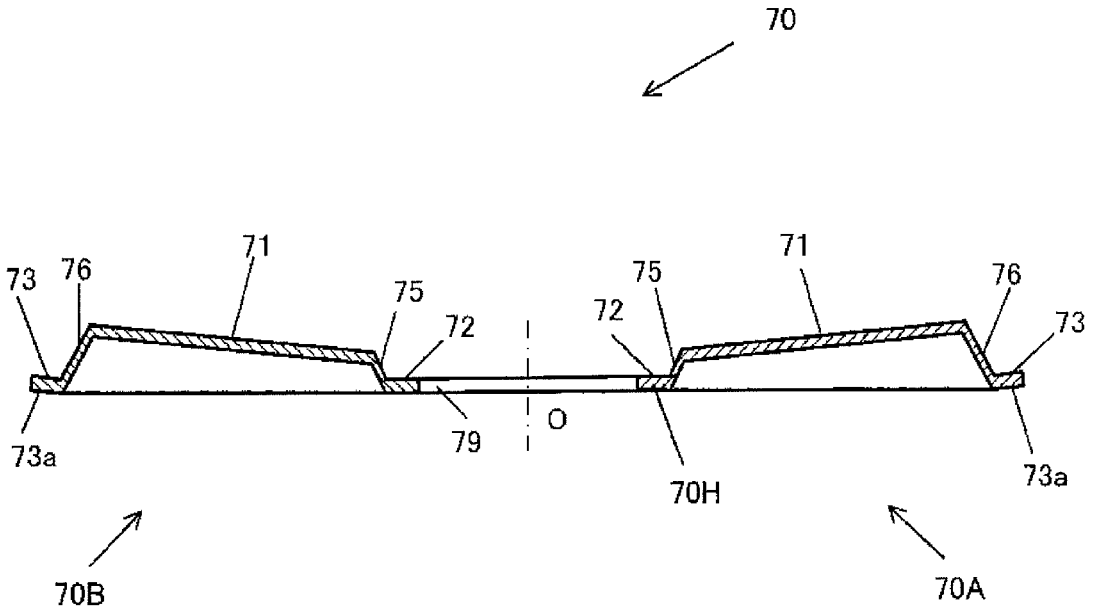
FIG. 4 is a sectional view taken along line IV-IV in FIG. 3.
Figure 5A:
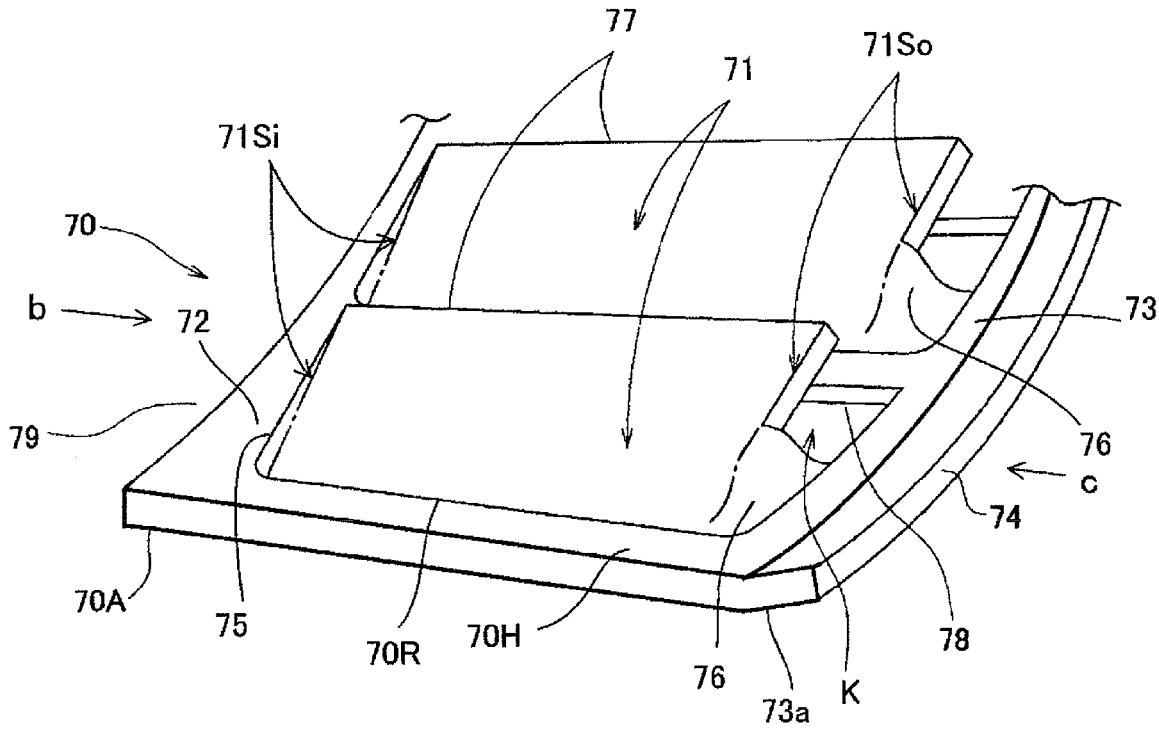
FIG. 5A is an enlarged perspective view of a region V in FIG. 3.
Figure 5B:
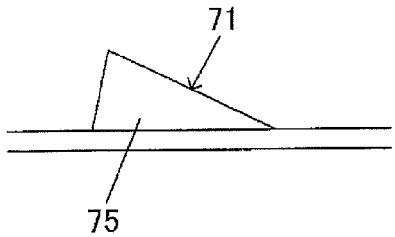
FIG. 5B is view of the stator blade when seen from the inner circumferential side.
Figure 5C:
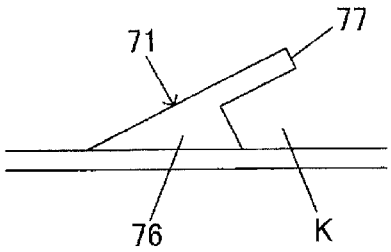
FIG. 5C is view of the stator blade when seen from the outer circumferential side.

FIG. 3 is a plan view of the stationary blade portion 70 shown in FIG. 1, FIG. 4 is a sectional view taken along line IV-IV in FIG. 3, FIG. 5A is an enlarged perspective view of a region V in FIG. 3, FIG. 5B is view of the stator blade when seen from the inner circumferential side, and FIG. 5C is view of the stator blade when seen from the outer circumferential side.

The stationary blade portion 70 is formed by combining two divided stationary blade portions 70A, 70B serving as the halved ring shape members. The divided stationary blade portions 70A, 70B are formed into the same shape. Each of the divided stationary blade portions 70A, 70B has an opening 79 in a center part, and serves as a half annular body in a plan view (hereinafter, also referred to as a half-disc shape for convenience). The divided stationary blade portions 70A, 70B include an outer circumferential rim 73, an inner circumferential rim 72, and a plurality of stator blades 71 extended in a radial manner with predetermined width in the circumferential direction between the outer circumferential rim 73 and the inner circumferential rim 72.

(Detailed Description of Stator Blade 71)

Although details will be described later, the stator blades 71 of this embodiment are manufactured by drawing. As shown in FIGS. 4 and 5, the stator blades 71 formed in the divided stationary blade portions 70A, 70B are extended in a radial manner with predetermined width in the circumferential direction between the outer circumferential rim 73 and the inner circumferential rim 72, and inclined at a predetermined blade angle with respect to a stationary blade portion main body 70H so as to forma plurality of exhaust openings 78. That is, the stator blade 71 stands from and is connected to the stationary blade portion main body 70H in a bent portion 70R extended linearly in the radial direction on a plane of the stationary blade portion main body 70H. The stator blade 71 is separated from the stationary blade portion main body 70H on the side of a front end side portion 77 which is the opposite side of the stationary blade portion main body 70H. A height of the front end side portion 77 of the stator blade 71 from the stationary blade portion main body 70H, that is, a blade height is formed to be higher on the outer circumferential side than the inner circumferential side.

The stator blade 71 is formed into a rectangular shape elongated in the radial direction in a plan view. This rectangular shape is formed by the bent portion 70R serving as a long side, the front end side portion 77 serving as a long side, an outer circumferential side end 71So serving as a short side, and an inner circumferential side end 71Si serving as a short side.

The divided stationary blade portions 70A, 70B respectively include inner circumferential side support portions 75 for connecting the inner circumferential side ends 71Si of the stator blades 71 to the inner circumferential rim 72, and outer circumferential side support portions 76 for connecting the outer circumferential side ends 71So of the stator blades 71 to the outer circumferential rim 73.

The inner circumferential side support portion 75 is formed over the entire length of the inner circumferential side end 71Si of the stator blade 71. The outer circumferential side support portion 76 is formed in correspondence to a part of the outer circumferential side end 71So of the stator blade 71. That is, the outer circumferential side support portion 76 is provided from the bent portion 70R where the stator blade 71 is bent from the stationary blade portion main body 70H to an intermediate part of the front end side portion 77, and a cutout K is provided on the front end side. The cutout K communicates with the exhaust opening 78 provided between the front end side portion 77 and the stationary blade portion main body 70H.

As described above, since the stator blade 71 is supported by the outer circumferential side support portion 76 connected to the outer circumferential rim 73 and the inner circumferential side support portion 75 connected to the inner circumferential rim 72, the stator blade has large rigidity. The blade height is greater on the outer circumferential side than the inner circumferential side. However, since the cutout K is formed in the outer circumferential side end 71So on the side of the front end side portion 77, generation of cracking in the outer circumferential side support portion 76 can be suppressed at the time of the drawing.

As shown in FIG. 5A, FIG. 5B and FIG. 5C, in the divided stationary blade portion 70A, an outer circumferential edge 73*a*, that is, a spacer nipping region of an outer circumferential edge of the outer circumferential rim 73 is bent toward the side of the stator blade 71.

FIG. 2 shows a state where the outer circumferential edge 73*a* of the stationary blade portion 70 is supported via the spacers 8 between the inner part upper wall portion 21*a* of the casing member 12 and the upper surface of the upper flange 13*a* of the base 13. Since the outer circumferential edge 73*a* is nipped by the spacers 8, the divided stationary blade portions 70A, 70B are supported in such a manner that the side of the inner circumferential rim 72 is floated up toward the side of the intake port 15, in other words, the side of the rotating blade portion 6 on the upper stage side.

As shown in FIG. 2, the divided stationary blade portions 70A, 70B are set in such a manner that a gap do between an upper surface of the stator blade 71 on the outer circumferential side and a lower surface of the rotating blade portion 6 on the upper stage side is substantially equal to a gap d between a lower surface of the stationary blade portion main body 70H on the outer circumferential side and an upper surface of the rotating blade portion 6 on the lower stage side. As described above, regarding the blade height of the stator blade 71 of the divided stationary blade portions 70A, 70B, a blade height hi on the inner circumferential side is smaller than a blade height ho on the outer circumferential side. That is, a gap di between an upper surface on the inner circumferential side of the stator blade 71 and the lower surface of the rotating blade portion 6 on the upper stage side is larger than a gap do between the upper surface of the stator blade 71 on the outer circumferential side and the lower surface of the rotating blade portion 6 on the upper stage side.

By floating up the side of the inner circumferential rim 72 of the divided stationary blade portions 70A, 70B, the gap d between the lower surface of the stationary blade portion main body 70H and the upper surface of the rotating blade portion 6 on the lower stage side is extended, and the gap di between the upper surface of the stator blade 71 and the lower surface of the rotating blade portion 6 on the upper stage side is narrowed down. However, originally, the gap di between the upper surface of the stator blade 71 on the inner circumferential side and the lower surface of the rotating blade portion 6 on the upper stage side is large and has extra room. That is, by floating up the inner circumferential side of the divided stationary blade portions 70A, 70B, the stator blade 71 is displaced in the direction in which the gaps between the stator blade 71 and the rotating blade portions 6 in the upper and lower stages are equal to each other. Therefore, contact between the divided stationary blade portions 70A, 70B and the rotating blade portions 6 can be prevented.

As shown in FIG. 2, a floating height s on the inner circumferential side from the outer circumferential edge 73*a* of the stationary blade portion main body 70H in the divided stationary blade portions 70A, 70B satisfies a relationship of:

$$(ho-hi)>s$$

in a case where the blade height on the outer circumferential side of the stator blade 71 is ho and the blade height on the inner circumferential side of the stator blade 71 is hi. As long as this condition is satisfied, the gap di between the upper surface on the inner circumferential side of the stator blade 71 and the lower surface of the rotating blade portion 6 on the upper stage side is never smaller than the gap do between the upper surface of the stator blade 71 on the outer circumferential side and the lower surface of the rotating blade portion 6 on the upper stage side. The contact with the rotating blade portions 6 can be reliably prevented.

(Manufacturing Method of Divided Stationary Blade Portion)

Next, referring to FIGS. 6 to 11, a manufacturing method of the divided stationary blade portions 70A, 70B will be described.

The divided stationary blade portions 70A and 70B are manufactured by the same manufacturing method. A manufacturing method of the divided stationary blade portion 70A as a representative will be described.

This manufacturing method includes a step of preparing a half-disc plate 70P, a step of forming radial cut lines 81 in the half-disc plate 70P, a step of forming openings 82 in the circumferential direction in outermost circumferential parts of the radial cut lines 81 of the half-disc plate 70P, a step of forming the stator blades 71 by the drawing, and a step of bending the outer circumferential edge 73*a* of the half-disc plate 70P.

Firstly, the half-disc plate 70P serving as a metal half-disc member in which the half-disc opening 79 is provided on the inner circumferential side is prepared. An aluminum alloy, stainless steel, and the like can be used as a material of the half-disc plate 70P.

Figure 6:
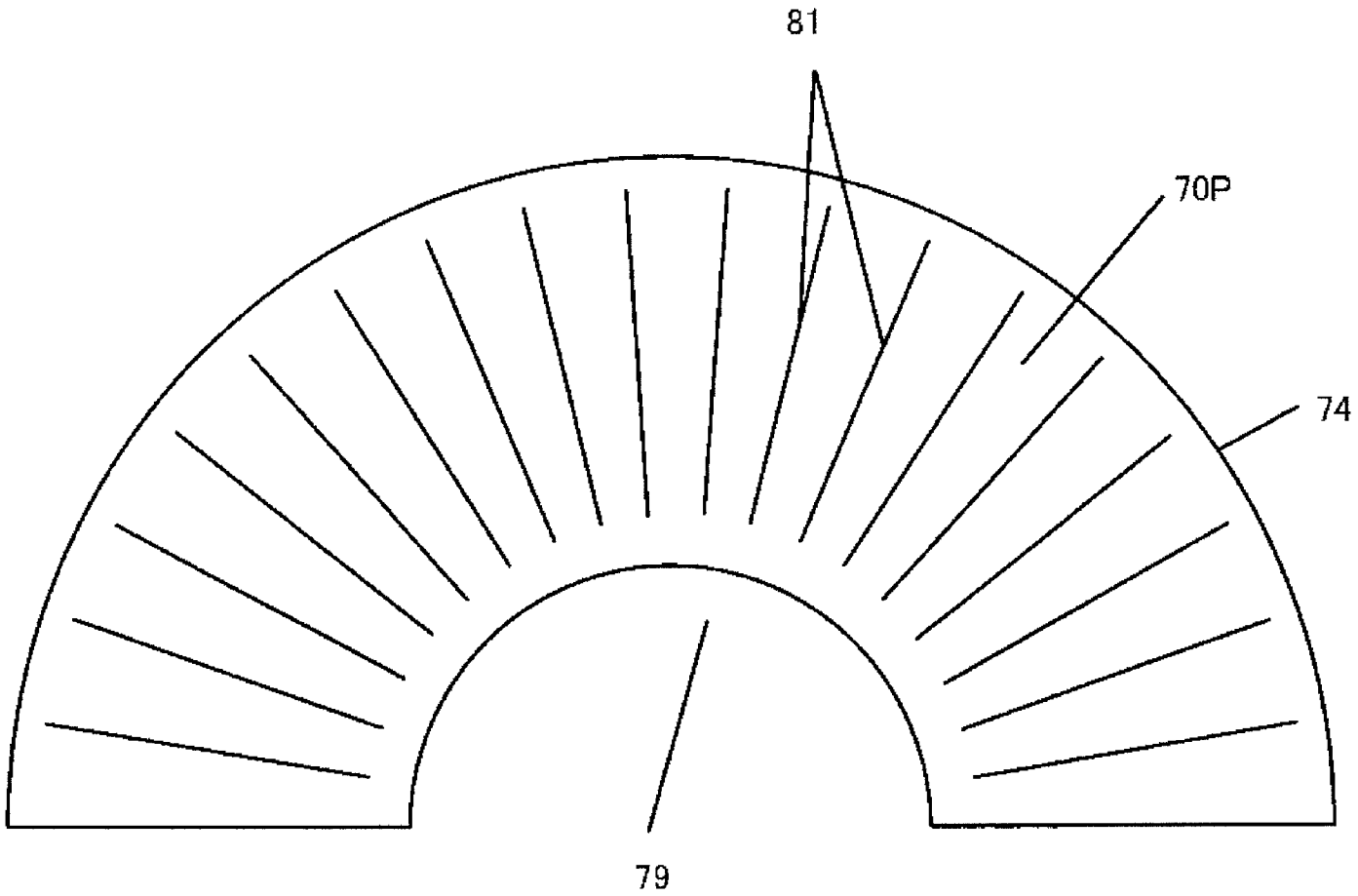
FIG. 6 is a plan view of a half-disc plate for illustrating a manufacturing method of the stationary blade portion.

As shown in FIG. 6, the plurality of straight cut lines 81 is formed in a radial manner in the half-disc plate 70P. The cut lines 81 can be formed by pressing or etching. The cut lines 81 serve as the front end side portions 77 after the drawing.

Figure 7:
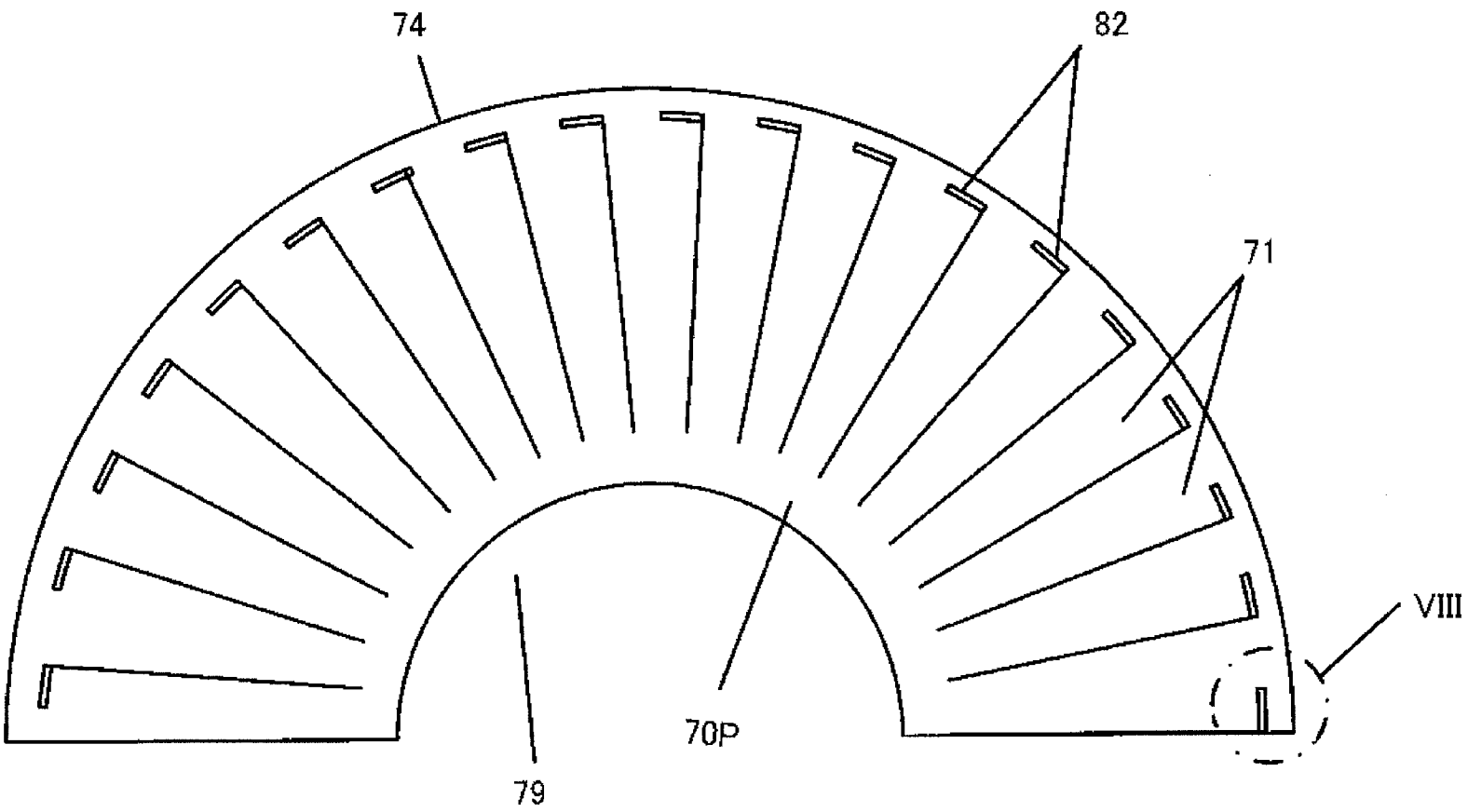
FIG. 7 is a plan view of the half-disc plate for illustrating a step following FIG. 6.

Next, as shown in FIG. 7, the substantially rectangular openings 82 along an outer circumferential surface 74 of the half-disc plate 70P are formed in outer circumferential ends of the cut lines 81. Although the openings 82 are formed by the pressing for efficiency, the openings may be formed by the etching. The openings 82 serve as the cutouts K after the drawing.

By a die and a punch, the stator blades 71 are drawn from the half-disc plate 70P. Hereinafter, referring to FIGS. 8 to 11, the drawing will be described in detail.

Figure 8:
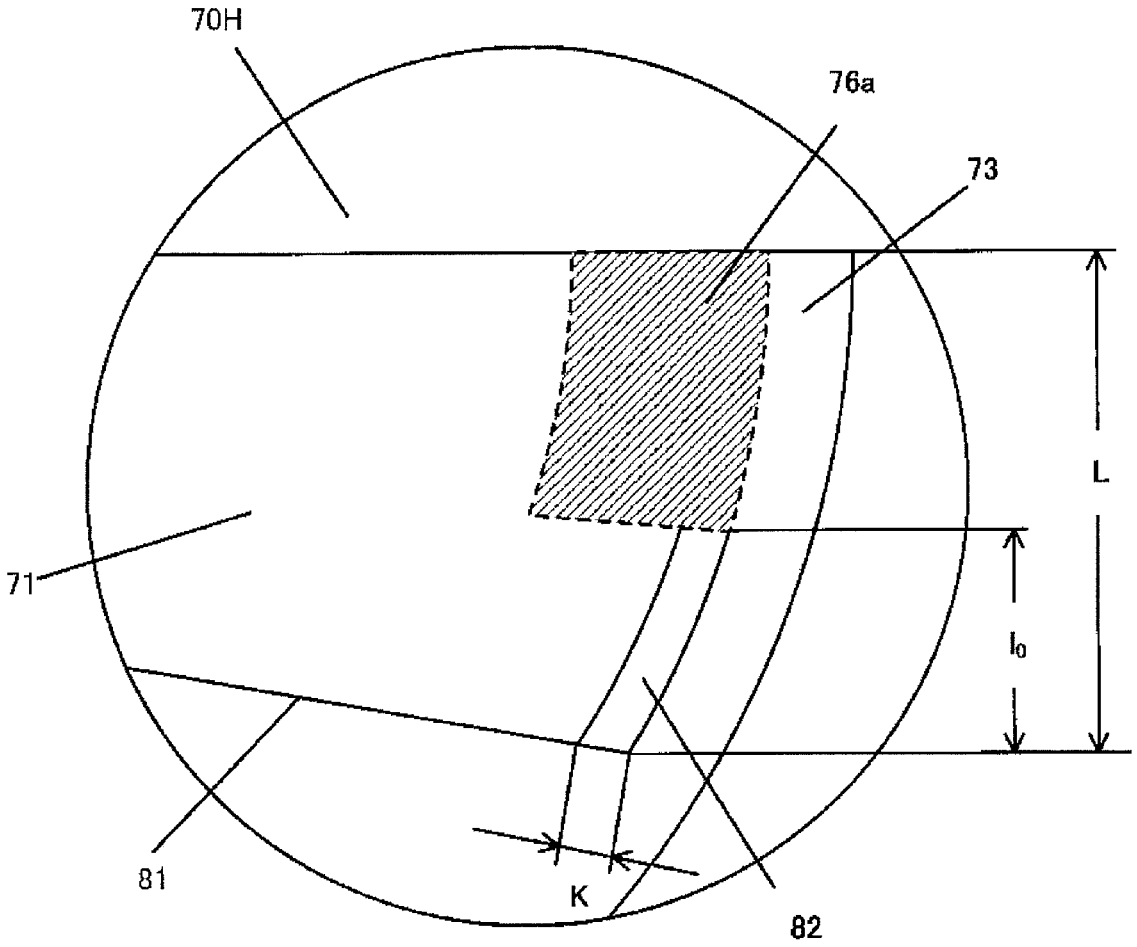
FIG. 8 is an enlarged view of a region VIII in FIG. 7.

FIG. 8 is an enlarged view of a region VIII in FIG. 7. In FIG. 8, a region 76*a* shown by hatching is a region becoming the outer circumferential side support portion 76 for connecting the stationary blade portion main body 70H and the outer circumferential rim 73 by the drawing. A length lo of the opening 82 is desirably less than a half of a length L of the entire outer circumferential side end 71So of the stator blade 71.

Figure 9A:
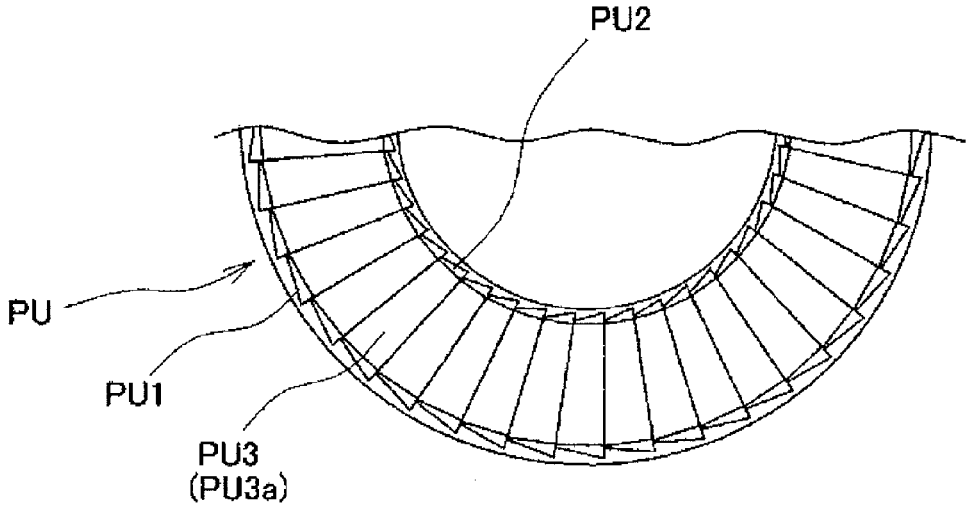
FIG. 9A is a plan view of a punch.
Figure 9B:
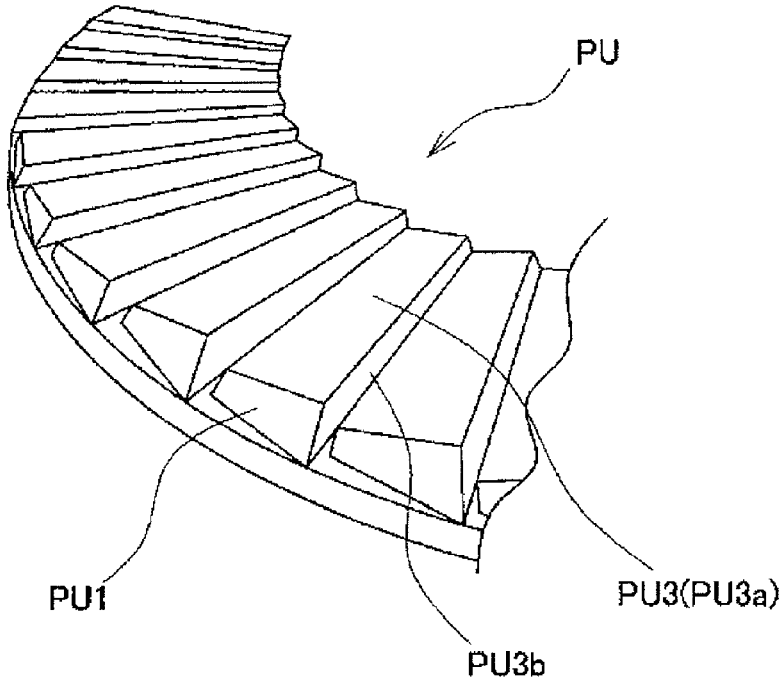
FIG. 9B is a perspective view of the punch.
Figure 10A:
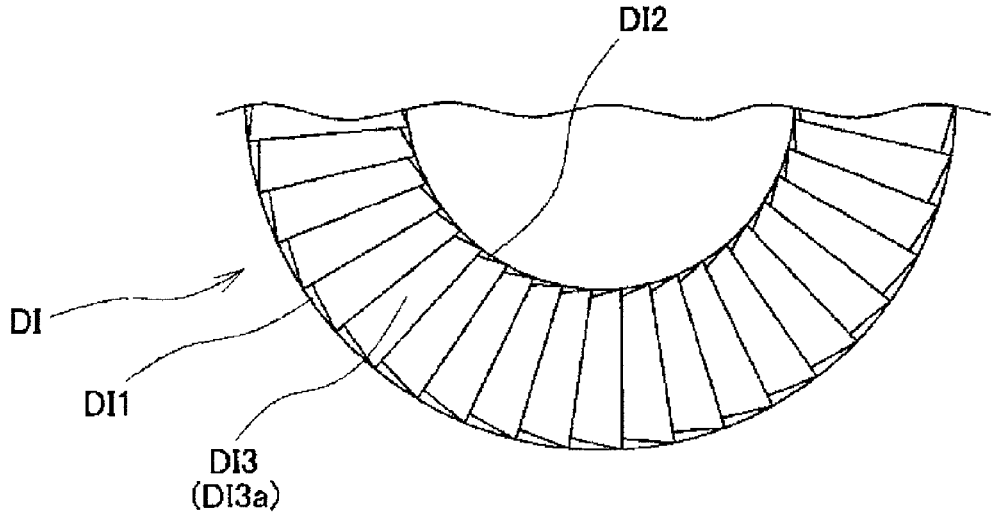
FIG. 10A is a plan view of a die.
Figure 10B:
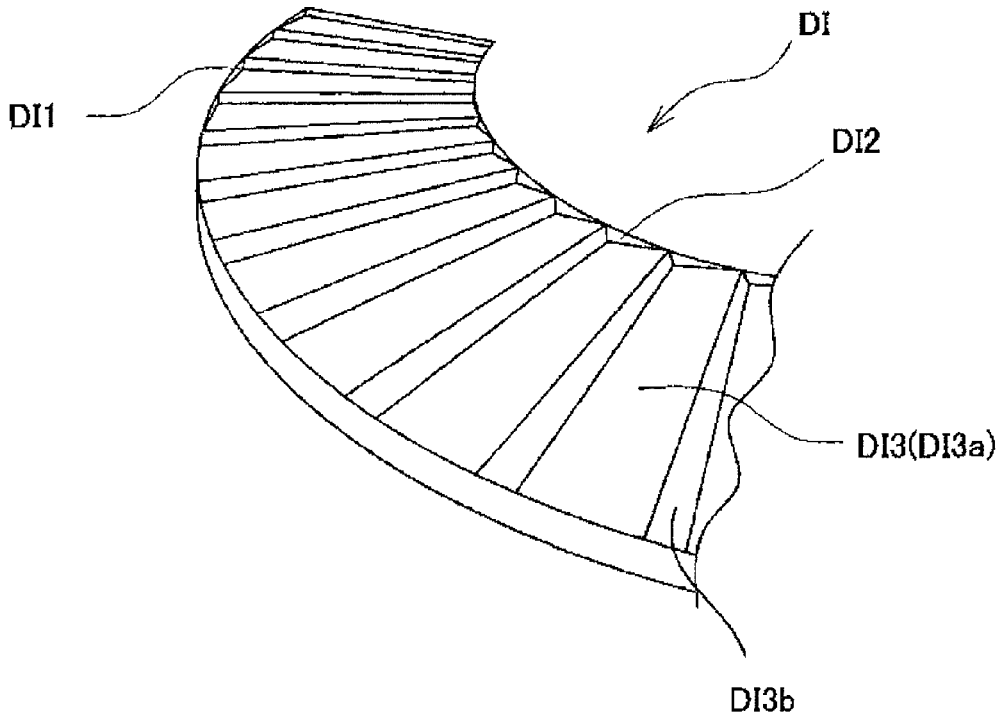
FIG. 10B is a perspective view of the die.
Figure 11A:
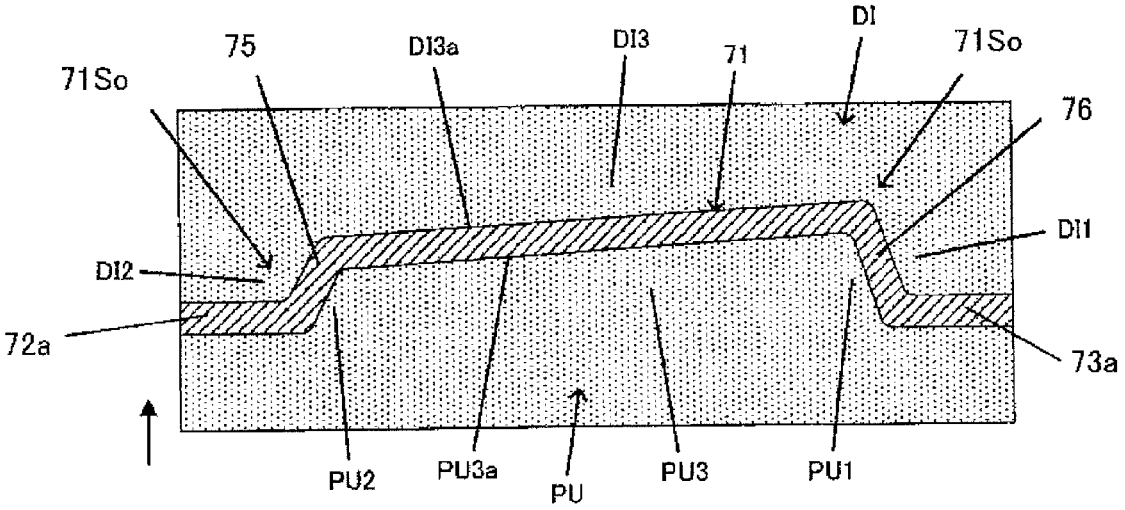
FIG. 11A is a sectional view taken along line XIa-XIa in FIG. 3 at the time of the drawing.
Figure 11B:
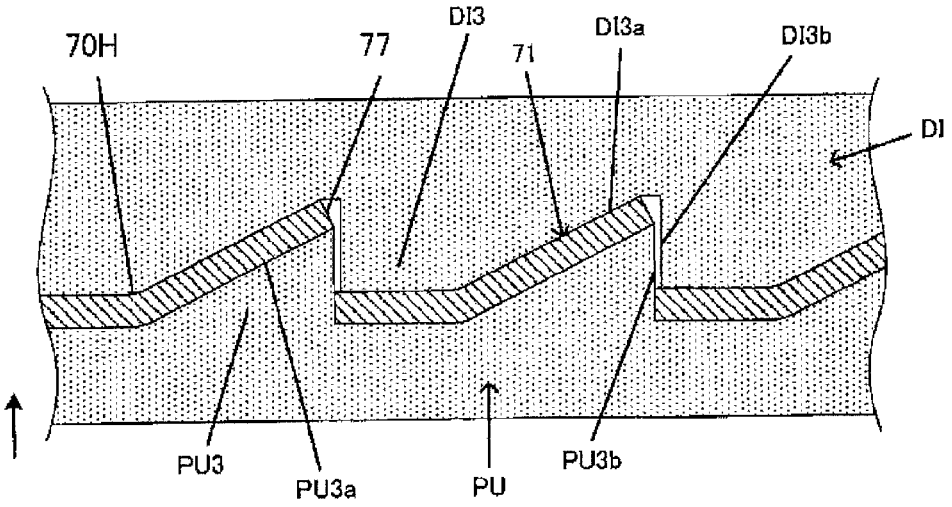
FIG. 11B is a sectional view taken along line XIb-XIb in FIG. 3 at the time of the drawing.

FIG. 9A is a plan view of the punch, FIG. 9B is a perspective view of the punch, FIG. 10A is a plan view of the die, and FIG. 10B is a perspective view of the die. FIGS. 11A and 11B are views for illustrating the method of forming the stator blade 71 by the drawing with using a punch PU and a die DI, FIG. 11A is a sectional view taken along line XIa-XIa in FIG. 3 at the time of the drawing, and FIG. 11B is a sectional view taken along line XIb-XIb in FIG. 3 at the time of the drawing.

As shown in FIGS. 9A, 9B, 11A, and 11B, the punch PU has an inclined portion PU1 projecting toward the lower surface side of the stator blade 71 from the outer circumferential rim 73 for forming the outer circumferential side support portion 76 of the stator blade 71. The punch also has an inclined portion PU2 projecting toward the lower surface side of the stator blade 71 from the inner circumferential rim 72 for forming the inner circumferential side support portion 75 of the stator blade 71. The punch PU includes a punch main body portion PU3 having an inclined surface PU3a projecting toward the front end side portion 77 from the bent portion 70R of the stationary blade portion main body 70H of the stator blade 71, the inclined surface PU3a being formed to be upgrade toward the outer circumferential rim 73 from the inner circumferential rim 72. An abutting end PU3b substantially parallel to the axial direction of the rotor shaft 5 is formed at a position of the punch main body portion PU3 corresponding to the front end side portion 77. The abutting end PU3b is to separate the front end side portion 77 of the stator blade 71 from the stationary blade portion main body 70H.

As shown in FIGS. 10A, 10B, 11A, and 11B, the die DI has an inclined portion DI1 recessed toward the upper surface side of the stator blade 71 from the outer circumferential rim 73 for forming the outer circumferential side support portion 76 of the stator blade 71. The die also has an inclined portion DI2 recessed toward the upper surface side of the stator blade 71 from the inner circumferential rim 72 for forming the inner circumferential side support portion 75 of the stator blade 71. The die DI includes a die main body portion DI3 having an inclined surface DI3a recessed toward the front end side portion 77 from the bent portion 70R of the stationary blade portion main body 70H of the stator blade 71, the inclined surface being formed to be downgrade toward the outer circumferential rim 73 from the inner circumferential rim 72. An abutting end DI3b substantially parallel to the axial direction of the rotor shaft 5 is formed at a position of the die main body portion DI3 corresponding to the front end side portion 77. The abutting end DI3b is to separate the front end side portion 77 of the stator blade 71 from the stationary blade portion main body 70H.

The half-disc plate 70P is set on the die DI, the punch PU is pushed out in the arrow direction, and the drawing is performed to the half-disc plate 70P, so that the stator blade 71 is manufactured. In this drawing, a three-dimensional plastic flow is generated in the region 76*a* of the diagonal lines of FIG. 8, so that the outer circumferential side support portion 76 is formed. By the plastic deformation of the region 76*a*, the opening 82 is three-dimensionally deformed in the blade height direction from a flat shape, so that the cutout K is formed.

The stationary blade portion main body 70H stands up from the bent portion 70R (refer to FIG. 6) into an inclined shape in such a manner that the cut line 81 formed in the half-disc plate 70P becomes the front end side portion 77, so that the stator blade 71 is formed. A space between the front end side portion 77 of the standing stator blade 71 and the stationary blade portion main body 70H becomes the exhaust opening 78 (refer to FIG. 5, FIG. 5B and FIG. 5C). The cutout K formed in an outer circumferential side part of the stator blade 71 is formed so as to be connected continuously to the exhaust opening 78.

After that, by the pressing, the outer circumferential edge 73*a* of the stationary blade portion main body 70H is bent toward the side of the stator blade 71. Thereby, the divided stationary blade portions 70A, 70B are formed.

In general, the gap do between the upper surface of the stator blade 71 and the lower surface of the rotating blade portion 6 on the upper stage side and the gap d between the lower surface of the stationary blade portion main body 70H and the upper surface of the rotating blade portion 6 on the lower stage side are about 0.5 to 1.0 mm. A difference (ho−hi) between the blade height ho on the outer circumferential side of the stator blade 71 and the blade height hi on the inner circumferential side is about 1.5 to 2.0 mm. A bent angle of the outer circumferential edge 73*a* is such an angle that a float-up amount on the inner circumferential side of the stator blade 71 does not exceed 1.5 to 2.0 mm.

As described above, according to the above embodiment, the following effects are obtained.

In the vacuum pump according to the present invention, in the stationary blade portion 70, the outer circumferential edge 73*a* is supported in such a manner that the inner circumferential side thereof is floated up toward the upper side in the axial direction of the rotor shaft 5, in other words, toward the side of the intake port 15, and the stationary blade portion 70 is supported in a float-up state. In the stator blade 71 provided in the stationary blade portion 70, the blade height ho on the outer circumferential side is greater than the blade height hi on the inner circumferential side, and the gap di from the rotating blade portion 6 on the upper stage side serving as the side of the intake port 15 is larger than the gap d from the rotating blade portion 6 on the lower stage side on the inner circumferential side of the stator blade 71. The inner circumferential side of the stator blade 71 is supported in a state that is displaced to the side of the rotating blade portion 6 on the upper stage side where the gap di is large. Thus, the contact with the rotating blade portion 6 can be reliably prevented.

The outer circumferential edge 73*a* of the divided stationary blade portion 70A is bent by plating which is plastic working. Therefore, productivity is favorable and advantageous in terms of cost.

Embodiment 2

Figure 12:
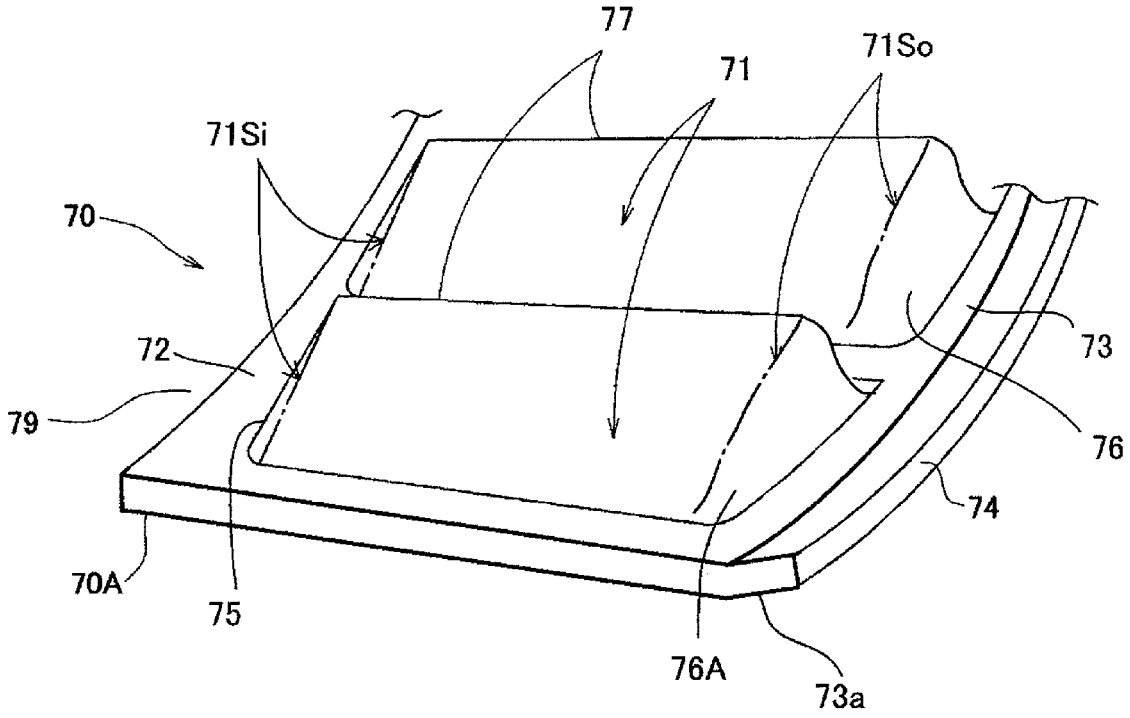
FIG. 12 is an enlarged perspective view of Embodiment 2 in major parts of the stationary blade portion of the present invention.

FIG. 12 is an enlarged perspective view of Embodiment 2 in major parts of the stationary blade portion of the present invention.

In Embodiment 2, different points from Embodiment 1 are as follows.

In the divided stationary blade portion 70A, an outer circumferential side support portion 76A for connecting the stator blade 71 and the outer circumferential rim 73 is formed over the entire length of the outer circumferential side end 71So of the stator blade 71 as well as the inner circumferential side support portion 75. That is, the cutout K formed in Embodiment 1 for separating the front end side portion 77 from the outer circumferential side support portion 76 is not provided.

In a case where a blade height of the outer circumferential side support portion 76A is not really high, without providing the cutout K for separating the front end side portion 77 of the stator blade 71 from the outer circumferential side support portion 76, no cracking is generated in the outer circumferential side support portion 76A. Therefore, by providing the outer circumferential side support portion 76A over the entire length of the outer circumferential side end 71So of the stator blade 71, rigidity can be enhanced.

In Embodiment 2, the outer circumferential edge 73*a* of the divided stationary blade portion 70A is bent toward the side of the stator blade 71 with respect to the inner circumferential side thereof. Therefore, as well as Embodiment 1, the inner circumferential side of the stator blade 71 is supported in a state that is displaced to the side of the rotating blade portion 6 on the upper stage side where the gap di is large. Thus, the contact with the rotating blade portion 6 can be reliably prevented.

Other elements are the same as Embodiment 1, corresponding configurations are given the same reference signs, and description thereof will be omitted.

Embodiment 3

Figure 13:
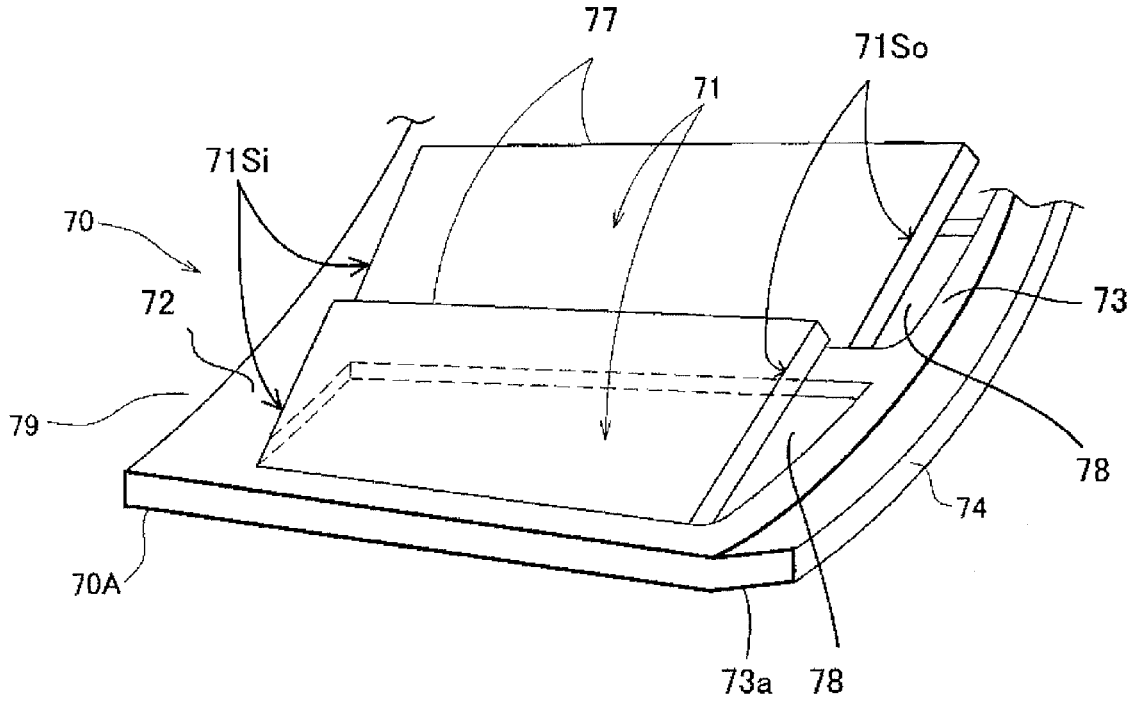
FIG. 13 is an enlarged perspective view of Embodiment 3 in the major parts of the stationary blade portion of the present invention.

FIG. 13 is an enlarged perspective view of Embodiment 3 in the major parts of the stationary blade portion of the present invention.

Embodiment 3 is different from Embodiment 1 at the following points.

The divided stationary blade portion 70A includes no outer circumferential side support portion 76 for connecting the outer circumferential side end 71So of the stator blade 71 and the outer circumferential rim 73, and no inner circumferential side support portion 75 for connecting the inner circumferential side end 71Si of the stator blade 71 and the inner circumferential rim. 72. That is, the inner and outer circumferential side ends 71Si, 71So of the stator blade 71 are respectively separated from the inner and outer circumferential rims 72, 73 over the entire length.

In a case where the blade height of the stator blade 71 from the stationary blade portion main body 70H is not really high, there is no need for providing the inner and outer circumferential side support portions 75, 76.

Thereby, a die can be inexpensive and production efficiency can be enhanced.

Also in Embodiment 3, the outer circumferential edge 73*a* of the divided stationary blade portion 70A is bent toward the side of the stator blade 71 with respect to the inner circumferential side thereof. Therefore, as well as Embodiment 1, the inner circumferential side of the stator blade 71 is supported in a state that is displaced to the side of the rotating blade portion 6 on the upper stage side where the gap di is large. Thus, the contact with the rotating blade portion 6 can be reliably prevented.

Other elements are the same as Embodiment 1, corresponding configurations are given the same reference signs, and description thereof will be omitted.

It should be noted that upon bending the outer circumferential edge 73*a* of the stationary blade portion 70 in such a manner that the inner circumferential side is floated up toward the side of the intake port 15, at least one stage of the stationary blade portions 70 arranged in multiple stages in the axial direction of the rotor shaft 5 may be bent (two, three, or all the stages of the stationary blade portions may be bent).

As described above, regarding the stationary blade portions 70, the blade height is formed to be higher on the upper stage side than the lower stage side in the stationary blade portions 70 arranged in multiple stages in the axial direction.

Therefore, the stationary blade portions 70 shown in Embodiments 1 to 3 may be differentiated in each stage. For example, the stationary blade portions 70 of Embodiment 1, Embodiment 2, and Embodiment 3 can be arranged in this order from the upper stage toward the lower stage side. An uppermost stator blade 71*a* may be the stationary blade portion 70 manufactured by mechanical working.

In the example of the above embodiment, the uppermost stationary blade portion 70 is nipped by the spacers 8. However, an upper surface of the uppermost stationary blade portion 70 may be supported by the inner part upper wall portion 21*a* of the casing member 12. In the example, a lower surface of the lowermost stationary blade portion 70 is supported by the abutting portion 13*a*1 provided in the upper flange 13*a* of the base 13. However, the spacer 8 may be installed in the upper flange 13*a* of the base 13 and the lower surface of the lowermost stationary blade portion 70 may be supported by this spacer 8.

The divided stationary blade portions 70A, 70B may be manufactured partly or entirely by the mechanical working. In particular, the outer circumferential edge 73*a* of the stationary blade portion 70 supported by the spacers 8 may be formed by grinding or the like at an angle inclined with respect to the stationary blade portion main body 70H.

The divided stationary blade portions 70A, 70B are not necessarily halved parts but may be a plurality of divided parts.

In the example of the above embodiment, the compound type turbo-molecular pump including the blade exhaust portion and the threaded groove exhaust portion is shown as an example of a vacuum pump. However, the present invention can also be applied to a vacuum pump including only a blade exhaust portion.

In addition, the present invention can be applied with various modifications within a range of the gist of the invention. That is, the present invention may be a vacuum pump having an exhaust portion formed by rotating blade portions and stationary blade portions, each of the stationary blade portions has a plurality of stator blades arranged in a stationary blade portion main body in the circumferential direction, in which a blade height on the outer circumferential side is greater than a blade height on the inner circumferential side, and an outer circumferential edge of at least one of the stationary blade portions is supported in such a manner that the inner circumferential side is floated up toward the intake port side.

What is claimed is:

1. A vacuum pump comprising:

an exhaust portion having a plurality of rotating blade portions arranged in multiple stages, each of the rotating blade portions having a plurality of rotor blades, and a plurality of stationary blade portions arranged between the rotating blade portions, in which outer circumferential rims are supported via spacers, each of the stationary blade portions having a plurality of stator blades, wherein in at least one stationary blade portion among the plurality of stationary blade portions, a blade height on the inner circumferential side of the plurality of stator blades provided in the stationary blade portion is set to be smaller than a blade height on the outer circumferential side of the plurality of stator blades, and in the at least one stationary blade portion the gap between the upper surface of the stationary blade portion on the inner circumferential side and the lower surface of the rotating blade portion on the upper stage side is larger than the gap between the lower surface of the stationary blade portion on the inner circumferential side and the upper surface of the rotating blade portion on the lower stage side, the stationary blade portion is supported by the spacers in such a manner that the inner circumferential side of the stationary blade portion is floated up toward an intake port side.

2. The vacuum pump according to claim 1, wherein the stationary blade portion includes an inner circumferential rim and the outer circumferential rim, the stator blades are provided between the inner circumferential rim and the outer circumferential rim, and by bending an outer circumferential edge of the outer circumferential rim, by a predetermined inclination angle, in the direction of upper surfaces of the stator blades from the outer circumferential rim, the inner circumferential rim is floated up to the intake port side.

3. The vacuum pump according to claim 1, wherein a floating height s of a front end of the inner circumferential rim from the outer circumferential edge satisfies a relationship of:

$$(ho-hi)>s$$

in a case where the blade height on the outer circumferential side of the stator blades is ho and the blade height on the inner circumferential side of the stator blades is hi.

4. A vacuum pump comprising:

an exhaust portion having a plurality of rotating blade portions arranged in multiple stages, each of the rotating blade portions having a plurality of rotor blades, and a plurality of stationary blade portions arranged between the rotating blade portions, in which outer circumferential rims are supported via spacers, each of the stationary blade portions having a plurality of stator blades, wherein in at least one stationary blade portion among the plurality of stationary blade portions, a blade height on the inner circumferential side of the plurality of stator blades provided in the stationary blade portion is set to be smaller than a blade height on the outer circumferential side of the plurality of stator blades, and in the at least one stationary blade portion the gap between the upper surface of the stationary blade portion on the inner circumferential side and the lower surface of the rotating blade portion on the upper stage side is larger than the gap between the lower surface of the stationary blade portion on the inner circumferential side and the upper surface of the rotating blade portion on the lower stage side, the stationary blade portion is supported by the spacers in such a manner that the inner circumferential side of the stationary blade portion is floated up toward a side of the rotating blade portion on an upper stage side.

* * * * *